United States Patent [19]

Papsco et al.

[11] 3,967,420

[45] July 6, 1976

[54] PORTABLE WALL SYSTEM AND METHOD OF INSTALLING SAME

[75] Inventors: William G. Papsco; Harry Cohn, Jr., both of Portola Valley, Calif.

[73] Assignee: Papsco, Inc., Sunnyvale, Calif.

[22] Filed: Apr. 30, 1974

[21] Appl. No.: 465,524

[52] U.S. Cl. ..... 52/127; 52/241; 52/741

[51] Int. Cl.[2] ..... E04B 2/74

[58] Field of Search ..... 52/122, 238, 241, 745, 52/242, 243, 64, 741; 160/40

[56] References Cited

UNITED STATES PATENTS

| | | | |
|---|---|---|---|
| 2,032,344 | 3/1936 | Barrows | 52/401 |
| 2,443,548 | 6/1948 | Wilson | 52/122 |
| 3,292,321 | 12/1966 | Schans | 52/241 |
| 3,341,992 | 9/1967 | Piper | 52/238 X |
| 3,703,792 | 11/1972 | Bill | 52/242 |
| 3,707,060 | 12/1972 | Jansen | 52/241 |
| 3,755,968 | 9/1973 | Williams | 160/40 |

FOREIGN PATENTS OR APPLICATIONS

| | | | |
|---|---|---|---|
| 1,523,409 | 3/1968 | France | 52/241 |
| 103,699 | 2/1964 | Norway | 52/243 |
| 1,180,335 | 2/1970 | United Kingdom | 52/238 |

*Primary Examiner*—John E. Murtagh
*Attorney, Agent, or Firm*—John F. Lawler

[57] ABSTRACT

A modular wall system comprises a plurality of wall modules in end to end relation, each module having a spring loaded ceiling channel engaging the ceiling and a floor channel frictionally or mechanically engaging the floor. The ceiling channel has a shallow upwardly opening longitudinally extending channel-shaped adapter plate on its top adapted to engage a strip secured to the underside of a ceiling tile support hanger for stabilizing and aligning the module. The ceiling and floor channels have sides formed with longitudinal grooves adapted to be engaged by a suitable dolly for contracting or expanding the ceiling channel away from or toward the ceiling to enable each module to be maneuvered into and out of position in the line of the wall.

A wall comprising a plurality of such modules is erected with the aid of the dolly by moving each module one at a time in a tilted position to the proposed wall line or plane with the spring-loaded ceiling channel contracted toward the top of the module, pivoting the module about an axis adjacent to the floor into the vertical plane of the wall with the bottom edge of the wall resting on the floor, and releasing the ceiling channel under pressure of the spring bias until the ceiling of the room is engaged thereby, and repeating these steps with successive modules in end to end position with each other to complete the wall. The wall is dismantled by performing the steps in reverse.

12 Claims, 11 Drawing Figures

PORTABLE WALL SYSTEM AND METHOD OF INSTALLING SAME

BACKGROUND OF THE INVENTION

This invention relates to portable walls and partitions, and more particularly to a portable modular wall and the method of erecting same.

The need for more efficient utilization of space in schools, auditoriums, convention halls, office buildings and the like has resulted in the development of portable space dividers and partitions which may be erected in finished rooms after installation of carpets and ceilings without damage to either and which may be removed or relocated therein as the need arises. An example of such a wall is the modular wall described in U.S. Pat. No. 3,753,328. The modules for such walls typically measure 4 ft. × 8 ft. × 3 in. and weigh 150 lbs. and accordingly require at least two men to handle each module during erection and dismantling of a wall. Moreover, the modules are awkward to handle even with two men and because of the metal framing defining sharp edges and corners are occasionally the cause of injury to the workmen during erection and removal of walls. Because of the ever increasing costs of labor, as well as the unavailability of manpower in maintenance crews for erecting such walls, there is need for a modular wall system that can be erected by one man. Furthermore, the increasingly stringent safety standards imposed by government regulations and the liability incurred due to inuuries sustained by workers on the job make it mandatory that risk of injury in erecting modular walls be minimized.

OBJECTS AND SUMMARY

A general object of this invention is the provision of a modular wall system which may be erected rapidly by one man.

A further object is the provision of such a wall that may be erected with minimum effort and physical strain to the workman and with maximum safety.

A further object is the provision of an improved method of erecting a modular wall.

In accordance with this invention, these and other objects are accomplished with a module construction which is especially adapted to be handled by one man with a suitable dolly for positioning the module into and out of the wall. Each module is engageable on either side by the dolly and has a spring-biased contractible upper or ceiling channel which is controlled from the dolly to reduce the height of the panel for installing or removing it in the plane of the wall. The module is erected by pivoting it on the dolly into a vertical plane while contracted and permitting the upper channel to expand under spring action into engagement with the ceiling. A floor gripper plate integral with the underside of the module frictionally or mechanically couples the panel to the floor covering.

DESCRIPTION OF PREFERRED EMBODIMENT

Figure 1:
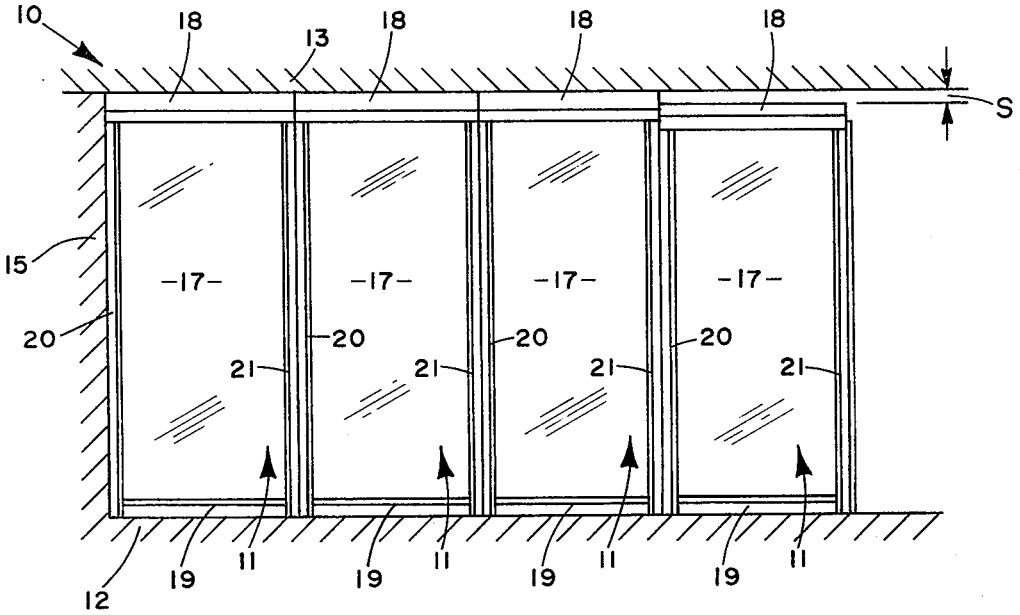
FIG. 1 is a side elevation of a partially installed wall comprising a plurality of modules embodying this invention.

Referring now to the drawings, FIG. 1 illustrates part of a modular wall 10 embodying the invention and comprising a plurality of plane modules 11 extending vertically between the floor 12 and ceiling 13 and positioned in end-to-end relation as shown to form an essentially continuous wall structure. The end module abuts side wall 15. The modules are essentially identical in construction and each comprises a main body portion or panel 17, a ceiling channel 18 and a floor channel 19 telescoped over the upper and lower edges, respectively, of the panel, and vertically extending posts 20 and 21 telescoped over and secured to the side edges of the panel.

Figure 3:
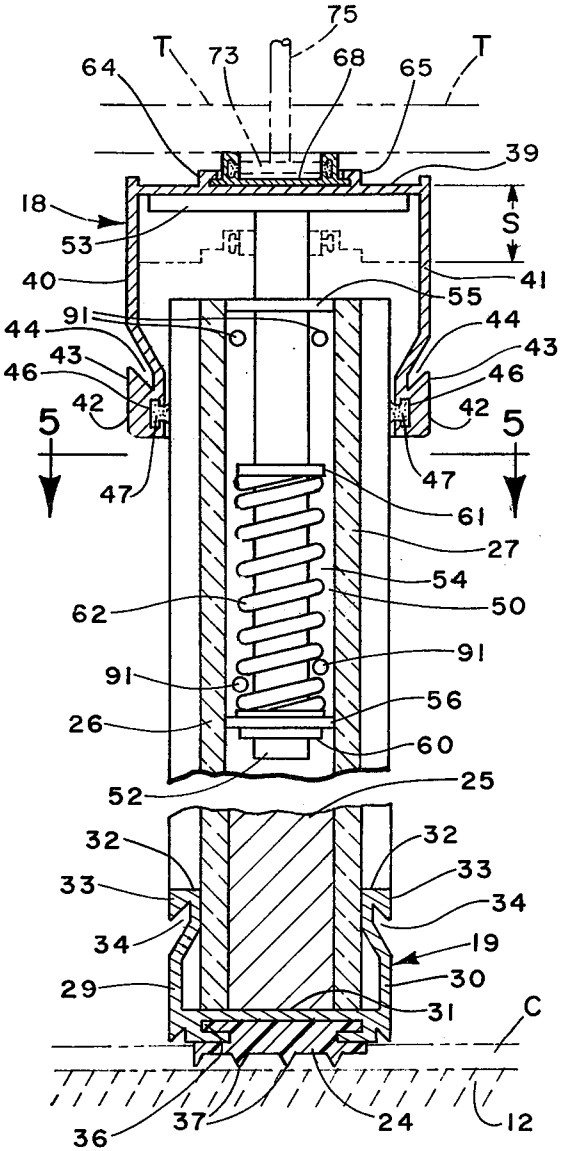
FIG. 3 is a transverse vertical section taken on line 3—3 of FIG. 2.
Figure 2:
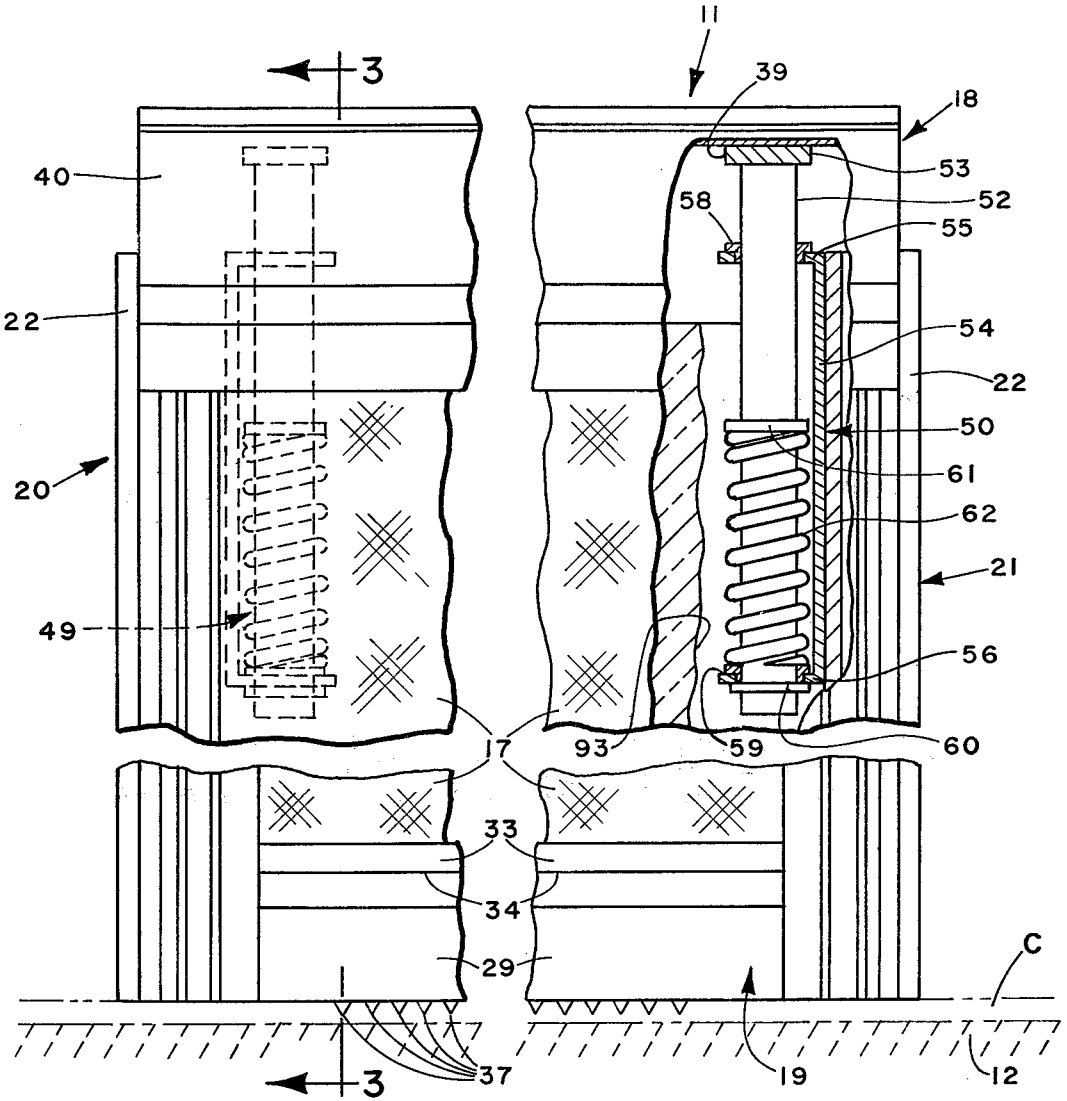
FIG. 2 is a greatly enlarged side elevation of part of one of the modules shown in FIG. 1 illustrating details of construction.

Each module in the wall is frictionally or mechanically coupled to the floor covering such as carpet C by a gripper plate 24, see FIGS. 2 and 3, preferably slidably interlocked to the underside of floor channel as described in the aforementioned patent. Each ceiling channel 18 is adapted to engage the ceiling 13 and is movable relative to the top of panel 17 toward and away from the ceiling to facilitate proper positioning of the module during erection and disassembly of the wall; the channel 13 on the end module at the right in FIG. 1 is shown in the retracted position spaced a distance S from the ceiling 13. Each of side posts 20 and 21 preferably has a projecting portion 22 and a recessed portion 23, see FIG. 5, which dovetail with recessed and projecting portions, respectively, of the adjacent module to provide an interlocking engagement for effectively integrating the modules into a substantially continuous wall. This side post construction is described in greater detail below.

Figure 5:
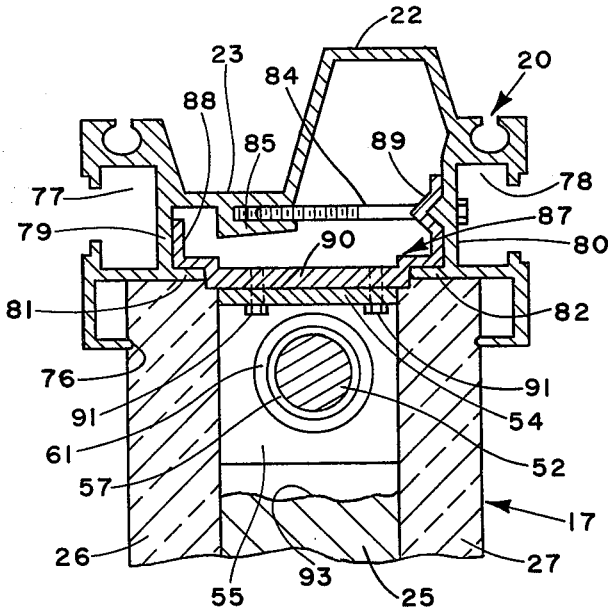
FIG. 5 is an enlarged horizontal section taken on line 5—5 of FIG. 3.

Panel 17 is a moderately lightweight laminar structure comprising a honeycomb center layer 25, see FIGS. 2, 3 and 5, cemented to outer layers 26 and 27 of porous composition board or tack board. A suitable fabric or decorative finish may be applied to the exterior of the composition boards which preferably have a density suitable to receive and hold thumb tacks and the like if desired or required.

Floor channel 19 extends between the inner edges of side posts 20 and 21 and has side walls 29 and 30 and a bottom wall 31 on which the bottom edge of the panel rests. The upper part of each of the channel side walls has an inwardly extending bead 32 adapted to engage the exterior of the panel and having an outer depending lip 33 defining with the inner part of the bead a downwardly and outwardly opening groove 34; these grooves preferably extend the full length of the channel. A T-shaped longitudinal slot 36 formed in the underside of bottom wall 31 receives gripper plate 23 in a slidably interlocked fit and plate 23 has downwardly projecting integral prongs 37 for mechanically engaging carpets and the like when used as the floor covering.

Ceiling channel 18 is telescoped over the top edge of panel 17 and the upper parts of both side posts 20 and 21 and has a top wall 39 and downwardly depending side walls 40 and 41, each having a bead 42 at its lower end. Each bead has an upwardly projecting lip 43 on the outer side defining with the inner part of the bead an upwardly and outwardly opening groove 44. The inner surface of each bead is formed with a longitudinally extending T-slot 46 and an antifriction strip 47 of suitable material such as tufted nylon is cemented into the parts of slot 46 that overlay side posts 20 and 21 so as to extend slightly inwardly from the bead and to provide a bearing surface between adjacent parts of the ceiling channel and side posts.

In accordance with this invention, ceiling channel 18 is retractible from and extendable toward the ceiling, and to this end channel 18 is resiliently supported at opposite ends on side posts 20 and 21 by substantially identical spring assemblies 49 and 50, respectively, one of which, assembly 49, is now described. Assembly 49 comprises a vertically extending rod 52 secured by block 53 to the underside of ceiling channel top wall 39 midway between the channel side walls. A vertical guide bar 54 rigidly secured to the inner upper side of post 21 has inwardly projecting end tabs 55 and 56 with vertically aligned openings in which bushings 57 and 58 are disposed for slidably receiving rod 52. Lock washer 60 fixed on the lower end of rod 52 establishes the limit of upward movement of the channel while permitting downward movement of same, and a similar upper lock washer 61 on the rod serves as an abutment for the upper end of helical spring 62 coaxially disposed about the rod and bottomed on lower tab 56. Washers 60 and 61 are axially adjustable on the rod to selectively vary respectively the vertical stroke of and the spring stress on the ceiling channel 18.

Figure 4:
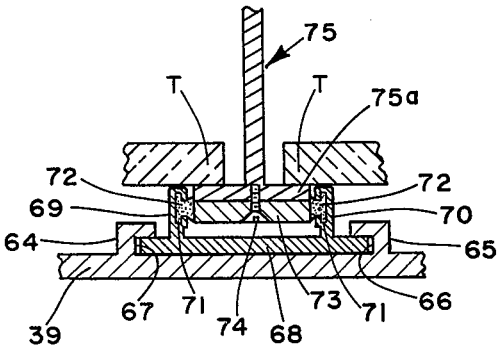
FIG. 4 is a greatly enlarged portion of the upper part of FIG. 3 illustrating the engagement of the top of the module with a strip on the ceiling tile support hanger or runner.

The upper side of top wall 39 of ceiling channel 18 has integrally formed upwardly projecting inverted L-shaped holders 64 and 65, see FIG. 4, laterally spaced symmetrically about the channel center plane and defining slots 66 and 67, respectively, for slidably receiving an adapter plate 68. Extending up from plate 68 are integral guides 69 and 70 laterally spaced symmetrically about ceiling channel center plane, each guide having an inwardly opening longitudinal slot 71 for holding a tufted antifriction strip 72. Guides 69 and 70 are spaced apart sufficiently to enable antifriction strips 72, during erection of the wall, to engage the exposed sides of a longitudinal strip 73 secured by screws 74 to the underside of the horizontal leg 75*a* of hanger 75 on which ceiling tiles T are supported, thereby providing lateral stability to the top of the module when erected and also facilitating alignment of the series of modules comprising the wall.

Each of side posts 20 and 21 preferably comprises a one-piece extrusion, see FIG. 5, defining the projecting portion 22 and recessed portion 23 on the outer side and a vertically extending opening 76 on the inner side receiving the side edge portion of panel 17. The sides of the post comprise channel-shaped portions 77 and 78 having inner walls 79 and 80, respectively, forming the bottoms of the channels and joined to transverse strips 81 and 82 against which the panel side edge abuts when fully inserted into the post. The channel-shaped portions 77 and 78 are engageable by suitable clamp means, not shown, for supporting shelves, blackboards and other accessories, if desired; such clamping means may, for example, be those described in U.S. Pat. No. 3,565,152. Vertically spaced screws, one of which is shown at 84, extend through inner side wall 80 into threaded engagement with a slotted head 85 on the inside of recessed portion 23 and draw the edges of the opening 76 against the sides of the panel.

A channel-shaped plate 87 having side walls 88 and 89 fitted within inner walls 79 and 80, respectively, of the post has a thicker transverse wall 90 which extends between strips 81 and 82. The purpose of plate 87 is to provide connection of spring assembly 50 to the side post; bar 54 of that assembly is secured to wall 90 of plate 87 by screws 91. Plate 87 is secured within the side post by one or more of the screws 84.

In order to provide room for spring assemblies 49 and 50, adjacent portions of the panel center layer 25 are hollowed out as indicated at 93.

Figure 6:
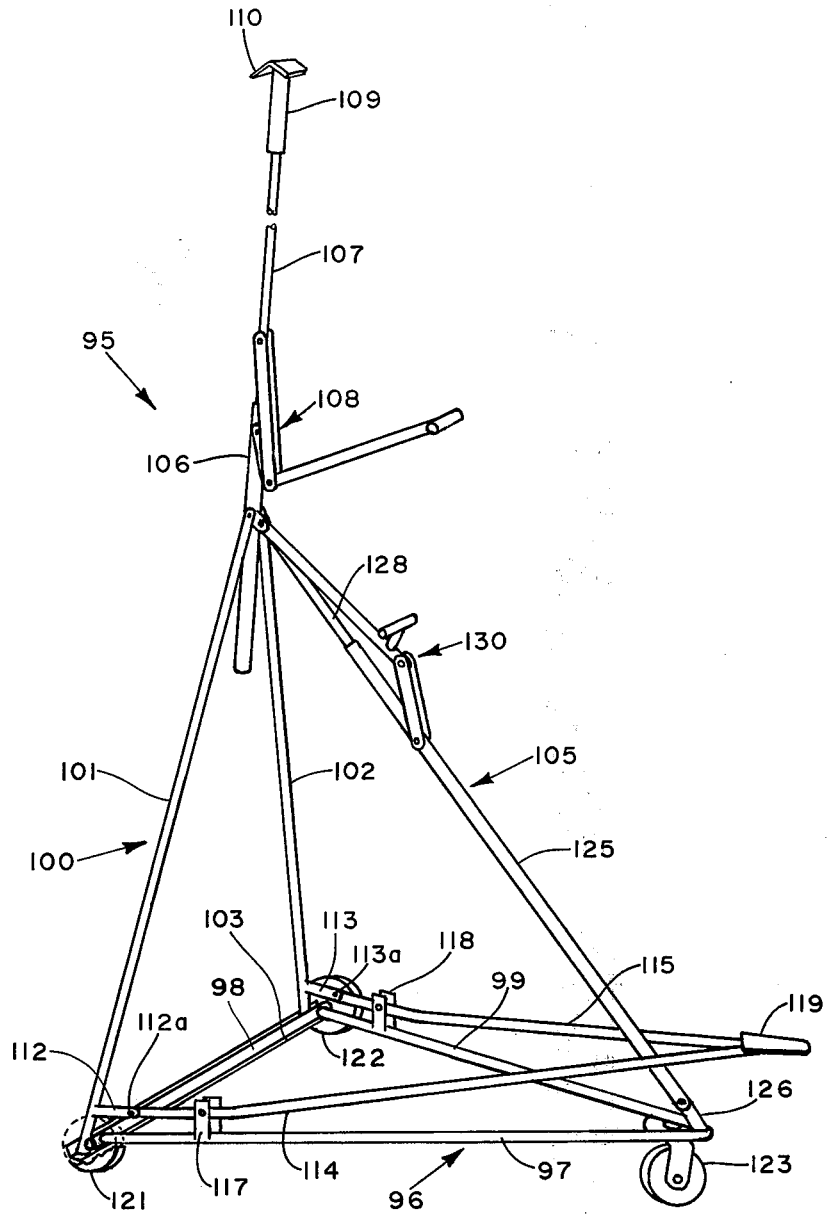
FIG. 6 is a perspective view of a module lifting and transporting dolly of the type useful in practicing the method of this invention.

In order to enable an installer to hold, transport, and erect each module in a vertical position in the plane of the wall, a dolly 95, see FIG. 6, is employed. This dolly does not per se constitute part of this invention and is described in detail in the copending application of W. G. Papsco et al, Ser. No. 465,523 assigned to the assignee of this invention. A brief description of the dolly 95 will now be given to provide a better understanding of the method of assembling and disassembling a modular wall in accordance with this invention.

Figure 7:
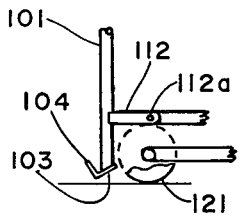
FIG. 7 is a side elevation of the lower front part of dolly of FIG. 6 showing the angled lift bar.

Dolly 95 is a tubular structure and comprises a triangularly-shaped base frame 96 having legs 97, 98 and 99, an upstanding A-frame 100 having upwardly converging and intersecting legs 101 and 102 supported at their lower ends on the front of the base frame adjacent to the ends and outside of leg 98, and a diagonal brace 105 connecting the intersection of A-frame legs 101 and 102 with the rearward intersection of base frame legs 97 and 99. Secured to the lower ends of A-frame legs 101 and 102 is an angle-shaped bar 103, see FIG. 7, having an upwardly and outwardly projecting lip 104 adapted to be engageable within groove 34 in one of the side walls of floor channel 19.

Connected to and extending upwardly from the junction of legs 101 and 102 and brace 105 is a tubular sleeve 106 from the upper end of which rod 107 extends for relative vertical movement. A manually actuatable lever 108 connected to sleeve 106 and rod 107 causes the latter to move vertically relative to sleeve 106. Head 109 resiliently connected to the top of rod 107 has an outwardly and downwardly extending lip 110 which is adapted to engage in groove 44 in one of the side walls of ceiling channel 18.

The lower rear sides of A-frame legs 101 and 102 have rigidly secured rearwardly projecting stubs 112 and 113, respectively, pivotally connected at 112*a* and 113*a* to the forward ends of rearwardly converging bars 114 and 115, respectively, which constitute a foot actuated lift lever. Bars 114 and 115 are pivotally supported near their forward ends on base frame legs 97 and 99, respectively, by connectors 117 and 118, respectively, and converge rearwardly around diagonal brace 105 to a junction on which foot pedal 119 is fastened.

The dolly is supported on fixed axis wheels 121 and 122 at the front corners of the base frame and by a caster 123 at the rear corner thereof.

Brace 105 comprises an elongated tube 125 pivotally connected at its lower end to an upwardly projecting stub 126 fixed to the rear corner of the base frame, and which telescopically receives at its upper end an extendable bar 128 which is secured at its outer end to the top of the A-frame. A double-link manually operable lever 130 connected between tube 125 and the top of the A-frame functions to extend and contract the length of the brace thereby pivoting the A-frame between vertical and tilted planes.

Figure 8:
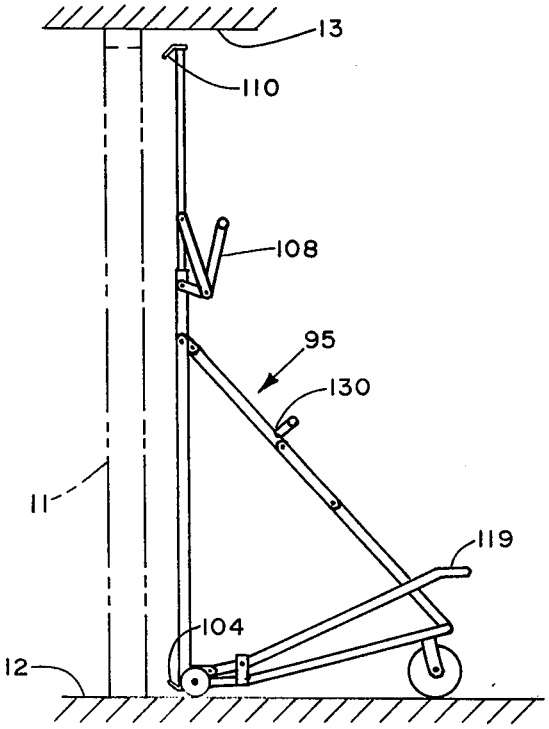
FIGS. 8, 9, 10 and 11 are side views of the dolly in various positions relative to a module during a sequence of steps in the removal of a module from the wall.

The method of manipulating each module for either erecting or disassembling a wall will be better understood by reference to FIGS. 8–11, inclusive, in which the sequence of steps followed in the removal of a module 11 from the wall is illustrated. As shown in FIG. 8, module 11, illustrated in broken lines for purposes of clarity, is in the vertical plane and extends between floor 12 and ceiling 13. The initial step in removing a module from the wall is to disengage its side post from that of the adjacent module by moving the module longitudinally over its gripper plate 24 and relative to the floor. Dolly 95 is then moved alongside the module with ceiling rod lever 108 in the up position so that lip 110 on top of rod 107 is at the entrance of or slightly above groove 44 in the side of module ceiling channel 18. At the same time, lip 104 on lower bar 103 is slightly above floor level and is aligned with groove 34 in the side wall of module floor channel 19. Lever 130 is collapsed against the back of brace 105 so that brace bar 128 is fully extended and A-frame 100 is in the vertical position. With the dolly parts in these positions, the dolly is advanced against the module so lips 110 and 104 are positioned at the entrance of the grooves in the ceiling channel and floor channel, respectively.

Figure 9:
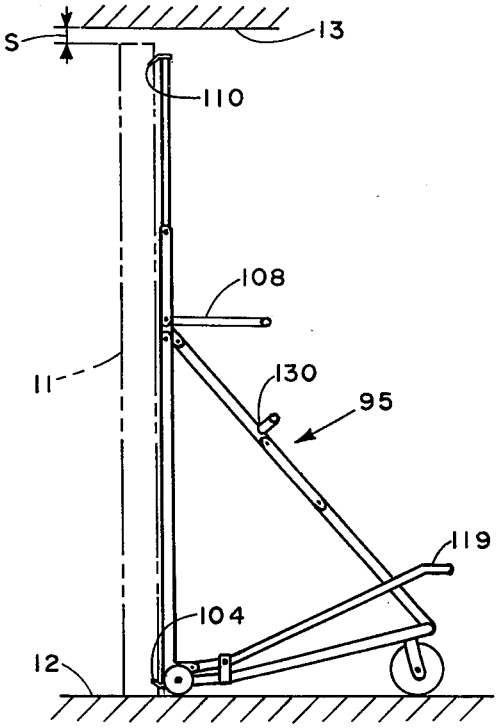

Lever 108 is then moved down to its lower limit as shown in FIG. 9 and the ceiling channel 18 is gripped along its groove 44 by lip 110 and is pulled down from the ceiling by the distance S against the bias of springs 62. Lower lip 104 still remains at the entrance of floor channel groove 34.

Figure 10:
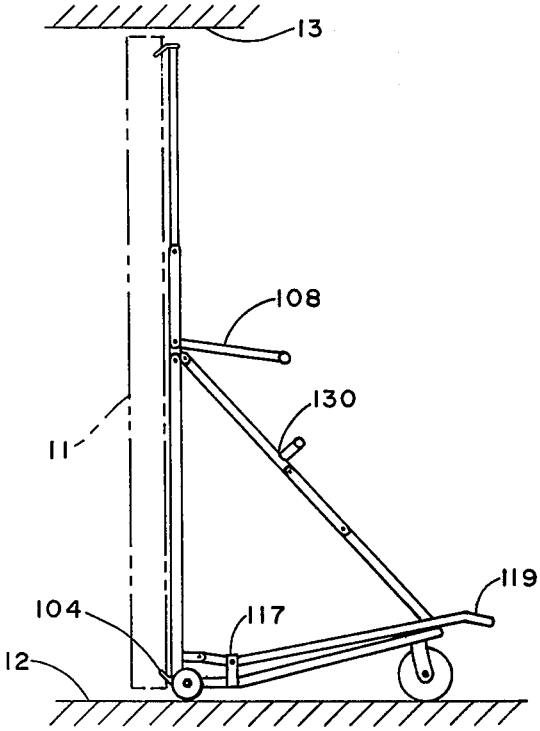

In the next step, the operator depresses foot pedal 119 of the lift lever, see FIG. 10, which elevates A-frame 100 so that lower lip 104 engages the floor channel through groove 34 and lifts the module to disengage friction plate 24 from the floor covering C; the distance through which the module is thus lifted is less than the retraction distance S of the ceiling channel and so the module is completely disengaged from the floor as well as the ceiling as shown in FIG. 10.

Figure 11:
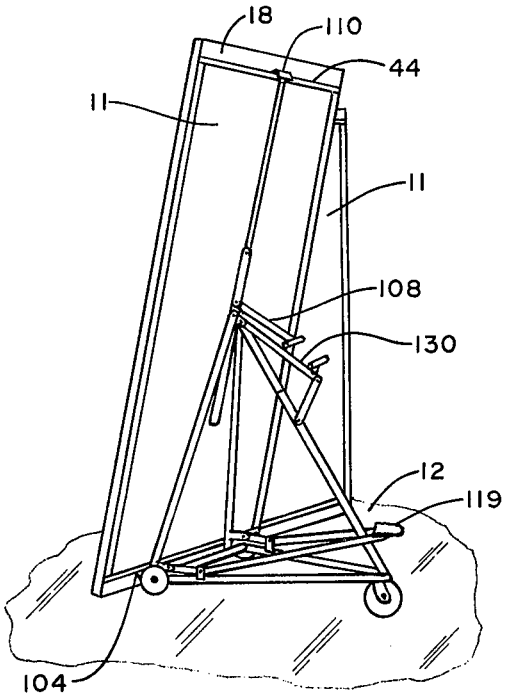

In order to tilt the module into a more readily transportable position on the dolly, brace lever 130 is retracted to the position shown in FIGS. 6 and 11 which in effect pulls bar 128 into tube 125 and shortens the length of the brace 105. This causes A-frame 100 to pivot rearwardly about the axes 112*a*, 113*a* thereby further spacing the top and bottom edges of the module from the ceiling and floor and shifting the weight of the module more evenly on the three wheeled supports. The operator then releases foot pedal 119 but because of its tilted position, the module still remains out of contact with the floor covering. The dolly with the module attached is then loaded and capable of being safely and easily moved from the wall site.

Erection of a module into the plane of the wall is accomplished by essentially repeating the above steps in reverse. Once the line position of the wall is established as by selection of a row of ceiling tile hangers for the center plane of the wall, the module is wheeled to that wall line clamped in the tilted position on dolly 95. Since the module is first set on the floor before engaging the ceiling, the wall line on the floor covering may be temporarily marked by a string or the like on the covering to visually assist the installer although a more skilled individual may well be able to do this without such an alignment aid. The installer has the option of pivoting the A-frame 100 (and the module) into the vertical plane by operating brace lever 130 with or without depressing foot pedal 119 at the same time. If the pedal is not depressed, the module floor channel immediately engages the floor as the module is pivoted to the vertical position; if it is depressed the module does not engage the floor when pivoted until and when the pedal is released. Between the options the installer can adopt the refinements that best suit his desires and skills. In any case, when the full weight of module is on the floor, the module floor channel is disengaged from the dolly, i.e., lip 104 is withdrawn from channel groove 34.

After the module is in the vertical plane of the wall and resting on the floor covering, the contracted ceiling channel is allowed to expand under spring pressure against the ceiling and more particularly into light engagement with the sides of strip 73 on horizontal leg 75*a* of the hanger 75, by upward movement of lever 108. The module being thus completely disengaged from the dolly, the latter is removed and the module is moved longitudinally relative to the floor covering into engagement with the adjacent module or wall.

It will be understood that prior to erecting the modular wall as described above, the installer secures the strip 73 in advance to the hanger leg 75*a* and thus establishes the plane of the intended wall. If it is desired to later remove or relocate the wall, strip 73 may be allowed to remain or, if desired, detached from the hanger.

What is claimed is:

1. The method of erecting a modular wall system comprising a plurality of modules in end to end relation extending between the floor and ceiling of a room, each module having a panel and a floor channel over the bottom of the panel and a ceiling channel telescoped over the top of the panel and spring biased upwardly toward the ceiling, consisting of the steps of gripping the floor and ceiling channels of a module with the ceiling channel contracted toward the top of the panel and the floor channel off the floor and moving the module to the wall site, resting the floor channel on the floor in the wall line while holding the ceiling channel in said contracted position, releasing the ceiling channel and causing the spring biasing force to move same up to the ceiling, and repeating the foregoing steps with additional modules.

2. The method according to claim 1 in which the module is tilted at an obtuse angle with the floor when transported to the wall site, the module being thereafter pivoted about an axis parallel to the floor into the vertical plane of the wall line.

3. The method according to claim 1 in which the sides of the ceiling and floor channels have longitudinally extending grooves, said channels being gripped by engagement with said channels.

4. The method according to claim 1 in which said ceiling has a longitudinally extending strip projecting downwardly from the plane of the ceiling and top of said ceiling channel has a pair of laterally spaced upwardly projecting longitudinal guides, said module being moved into a vertical plane until said guides are aligned with said strip, said ceiling channel being thereafter released and said guides engaging opposite sides of said strip.

5. In a modular wall system comprising a plurality of modules adapted to extend between the floor and the ceiling of a room, each module comprising a panel having top and side edges and a bottom edge supported on the floor, a post telescoped over each of said side edges, a ceiling channel telescoped over the panel top edge and upper portions of said posts, said channel having a top wall and side walls depending from said top wall, at least one of said channel side walls having a longitudinally extending upwardly and outwardly opening groove adapted to be engaged for moving the channel toward the panel top edge, a floor channel telescoped over the bottom of said panel and having a bottom wall against the panel bottom edge and side walls projecting upwardly therefrom on opposite sides of the panel, at least one of said floor channel side walls having a longitudinally extending downwardly and outwardly extending groove adapted to be engaged for lifting the module from the floor, and spring means supporting said ceiling channel on at least one of said side posts and resiliently spacing said channel top wall from said panel top edge, said ceiling channel being movable toward said panel against the force of said spring means whereby to reduce the height of the module for installation and removal of same in a wall system.

6. A modular wall system comprising a plurality of modules adapted to extend between the floor and the ceiling of a room, each module comprising a panel having top and side edges and a bottom edge supported on the floor, a post telescoped over each of said side edges, a ceiling channel telescoped over the panel top edge and the upper portions of said posts, said channel having a top wall and side walls depending from said top wall, and spring assembly means directly interconnecting said ceiling channel and at least one of said side posts and resiliently spacing said channel top wall from said panel top edge, said ceiling channel being movable toward said panel against the force of said spring assembly means whereby to reduce the height of the module for installation and removal of same in a wall system, said spring assembly means comprising a rod secured to and extending downwardly from the underside of said ceiling channel top wall, support means secured to the inner side of one of said side posts for guiding vertical movement of said rod, a spring compressed between said support means and said rod for urging the latter in the upward direction, and stop means on said rod adapted to abut said support means and limit upward movement of said rod and said ceiling channel.

7. The system according to claim 6 in which said stop means is vertically adjustable on said rod whereby to adjust the upper limit of movement of said ceiling channel.

8. The system according to claim 6 in which each module has a pair of spring means resiliently connecting opposite longitudinal ends of the ceiling channel to the side posts, respectively.

9. A modular wall system comprising a plurality of modules adapted to extend between the floor and the ceiling of a room, each module comprising a panel having top and side edges and a bottom edge supported on the floor, a post telescoped over each of said side edges, a ceiling channel telescoped over the panel top edge and the upper portions of said posts, said channel having a top wall and side walls depending from said top wall, at least one of said side walls having external engagement means adapted to be engaged for moving the channel toward the panel top edge comprising a longitudinally extending upwardly and outwardly opening groove adjacent the lower edge of the side wall, and spring assembly means directly interconnecting said ceiling channel and at least one of said side posts and resiliently spacing said channel top wall from said panel top edge, said ceiling channel being movable toward said panel against the force of said spring assembly means whereby to reduce the height of the module for installation and removal of same in a wall system.

10. The system according to claim 9 in which each of said channel side walls has one of said grooves.

11. A modular wall system comprising a plurality of modules adapted to extend between the floor and the ceiling of a room, each module comprising a panel having top and side edges and a bottom edge supported on the floor, said panel top edge being spaced a fixed distance above the floor when the module rests on the floor in an upright position, a post telescoped over each of said side edges, a ceiling channel telescoped over the panel top edge and the upper portions of said posts, said channel having a top wall and side walls depending from said top wall, and spring assembly means directly interconnecting said ceiling channel and at least one of said side posts and resiliently spacing said channel top wall from said panel top edge, said ceiling channel being movable toward said panel against the force of said spring assembly means whereby to reduce the height of the module for installation and removal of same in a wall system, said spring means comprising a spring and an adjustable stop coacting with said spring for limiting expansion of the spring and thereby limiting movement of said ceiling channel outwardly from said panel whereby to establish a predetermined spacing between said channel top wall and said panel top edge, said ceiling comprising longitudinally extending strip means having side edges, said ceiling channel top wall having laterally spaced vertically extending guide means engageable with said strip side edges whereby to laterally stabilize said module and to longitudinally align same with other modules in the system.

12. The system according to claim 11 in which said ceiling also comprises tiles and tile support hangers having horizontal support legs, said strips being secured to the undersides of said hanger legs.

* * * * *